United States Patent [19]

Fournier et al.

[11] Patent Number: 4,520,859

[45] Date of Patent: Jun. 4, 1985

[54] APPARATUS FOR RAPID SOLIDIFICATION OF THIN METALLIC STRIPS ON A CONTINUOUSLY MOVING SUBSTRATE

[75] Inventors: Pascal Fournier, Paris; Jean-Claude Peraud, Mandres Les Roses, both of France

[73] Assignee: Pont-A-Mousson, S.A., Nancy, France

[21] Appl. No.: 284,346

[22] Filed: Jul. 17, 1981

[30] Foreign Application Priority Data

Jul. 18, 1980 [FR] France ..... 80 15918

[51] Int. Cl.[3] ..... B22D 11/06; B22D 27/15

[52] U.S. Cl. ..... 164/253; 164/415; 164/423; 164/429; 164/443

[58] Field of Search ..... 164/415, 423, 427, 429, 164/432, 443, 253, 474, 475, 479, 481; 148/403

[56] References Cited

U.S. PATENT DOCUMENTS

| | | | |
|---|---|---|---|
| 2,886,866 | 5/1959 | Wade | 164/463 |
| 3,607,198 | 9/1971 | Meunier et al. . | |
| 3,862,658 | 1/1975 | Bedell | 164/485 X |
| 3,965,966 | 6/1976 | Gunnergaard | 164/213 |
| 4,077,462 | 3/1978 | Bedell et al. | 164/429 |
| 4,091,862 | 5/1978 | Lehmann et al. | 164/443 X |
| 4,142,571 | 3/1979 | Narasimhan | 164/429 X |
| 4,193,440 | 3/1980 | Thorburn et al. | 164/432 |
| 4,271,894 | 6/1981 | Kimura et al. | 164/481 |
| 4,339,508 | 7/1982 | Tsuya et al. | 164/429 X |

FOREIGN PATENT DOCUMENTS

| | | | |
|---|---|---|---|
| 2382297 | 9/1978 | France . | |
| 53-35005 | 9/1978 | Japan | 164/479 |
| 1093409 | 11/1967 | United Kingdom . | |

OTHER PUBLICATIONS

Chaudhari, P. et al., "Metallic Glasses", in *Scientific American*, vol. 242, No. 4, Apr. 1980, pp. 84–96.

"Des Soucopes Volantes au Bureau D'Etude", in *Science et Vie*, Aug. 1974, pp. 68–73.

*Primary Examiner*—Kuang Y. Lin
*Assistant Examiner*—J. Reed Batten, Jr.
*Attorney, Agent, or Firm*—Pennie & Edmonds

[57] ABSTRACT

A thin strip of metal or alloy is subjected to rapid solidification as it is ejected under pressure in a molten state from a crucible onto a cold, continuous band moving at high speed beneath the crucible's opening, in order to form metal strips in the vitreous state. An atmosphere under reduced pressure surrounding the zone of impact of the molten metal on the band is provided by a partially evacuated housing having opposed narrow inlet and outlet openings through which the band passes. The band is cooled and precisely positioned, and its vibration is minimized, by ejecting fluid from openings in the bottom of the housing, over which the band passes in closely parallel fashion. A pressurized gas at low temperature, ejected through these openings in the direction of the band, creates a fluid cushion between the band and the bottom of the housing. Curved fluid-ejecting units acting analogously to pulleys may be provided to define the path of the continuous band and to form similar fluid cushions between the band and themselves. The metal may advantageously be brought out of the housing by the moving band into an atmosphere of higher pressure before its temperature reaches the temperature of vitrification of the metal.

19 Claims, 10 Drawing Figures

APPARATUS FOR RAPID SOLIDIFICATION OF THIN METALLIC STRIPS ON A CONTINUOUSLY MOVING SUBSTRATE

TECHNICAL FIELD

This invention relates to the manufacture of thin strips of metal by casting and quick setting molten metal on a cold substrate which is moving at high speed and in particular to the production of metal materials in the vitreous state by means of a rapid solidification process.

BACKGROUND ART

A process for imparting a vitreous structure, i.e., one which fails to exhibit any crystalline structure on X-ray exposure ("Les verres metalliques" (Metal glasses), Praveen Chaudhari, Bill Giessen and David Turnbull, "Pour la Science," June 1980, No. 32, p. 68), and Scientific American, Vol. 242, No. 4, at 84–96 (April 1980) by cooling certain molten metals or alloys at very high speed, i.e., rapid quenching, of the order of $10^6$ °C./second, is known.

Such process for producing an amorphous metallic structure generally comprises projecting a jet of molten metal, which spreads in the form of a very thin layer over a cooled surface that is a good heat conductor and which is moving at high speed.

Different processes of solidification on cold moving surfaces have been proposed in the prior art. For example, these processes include, among others, solidifying the metal in the following ways, inside a wheel, on a drum, on a disk and between two rollers. The simplest and most commonly used method consists of projecting a jet of molten metal over the outside surface of a cold metal wheel turning at high speed. The molten metal, ejected under pressure from a crucible, forms a stationary bulb on contact with the wheel which produces a rapidly solidified metal strip. The latter, under the effect of centrifugal force, separates from the cold wheel and is ejected.

Studies made of these different types of processes have revealed the influence of the boundary gaseous layer in contact with the cold surface on the quality of the edges and surface state of the metallic strip.

These studies have led to proposals of operating under a controlled atmosphere and, notably, under low pressure, by placing all of the equipment in a closed vessel. One major disadvantage of this technique, however, resides in the volume of the vessel to be built, particularly when the process is used on an industrial scale. Moreover, when a vacuum is applied to the system, it cannot be applied continuously because the vacuum is necessarily broken every time the strip produced is to be recovered. In addition, it has been found that, in the process of rapid solidification on a wheel, separation of the strip takes place more rapidly when operating under vacuum than when the process is conducted in the open, and that solidification is less intense.

It is, of course, possible to contemplate rapidly solidifying hyperhardening under vacuum and continuously bringing the strip out of the vessel, but it is difficult to adapt a vacuum vessel to a very fast-turning wheel which permits the maintenance of a satisfactory continuous vacuum, while allowing the strip to emerge into the atmosphere, especially in view of the fact that separation of the metal strip from the wheel is an unstable phenomenon.

This serious disadvantage, in particular, led to the search for a technique of rapid solidification under a controlled atmosphere which did not involve centrifugal force, and with that end in view, use of the method of rapid solidification on a moving band, passing at great speed under the jet of molten metal. This method, known in principle, presents appreciable disadvantages, principally among which are the vibrations of the supporting band and, in general, the imprecision of its positioning, resulting, in particular, from its fast-turning pulley drive, the difficulty of cooling the band effectively and a greater complexity of use than rapid solidification on a wheel.

SUMMARY OF THE INVENTION

This method is aimed at overcoming those difficulties with use of the process of rapid solidification on a moving band, with a view to utilizing it under a controlled atmosphere, and possibly under reduced pressure. It makes it possible to position the moving band precisely and to render its vibrations negligible, while assuring its cooling, at least in part, by placing opposite at least one of the faces of that band a unit containing one or more openings (holes, slits, etc.) through which a fluid under pressure, preferably, a gas at low temperature, is ejected in the direction of the band, in order to create, between the latter and the unit, a fluid cushion which maintains the band without friction on said unit, while assuring the band's cooling by formation of a fluid cushion employing the Coanda effect. That effect is described, for example, in an article in "Science et Vie," August 1974, pp. 68–73 (pub. Excelsior Publications, 5, rue de la Baume, Paris 8e).

This invention therefore relates to an apparatus for rapidly solidifying a metal or an alloy on its formation into a thin strip, said device containing a band moving past at high speed below an opening for ejection under pressure of a metal or alloy in the molten state in which, opposite at least one of the faces of said band, and in proximity to the zone of impact of the molten metal or alloy on that band, there is at least one unit containing at least one opening for ejection of a fluid under pressure, preferably at low temperature, creating between said band and the unit a fluid cushion which maintains the band without friction on said unit.

One unit is preferably placed "upstream" with respect to the direction of movement of the band of the impact zone of the molten metal and it can advantageously be situated opposite the impact face in case it is desired to modify the nature of the gas of the boundary layer in said impact zone.

The openings for ejection of this fluid under pressure may consist of straight slits or small holes, aligned in one or more rows.

Said band will usually consist of a continuous metal strip pulled by a drive member such as a drum or a pulley and passing over one or more return members. The return members will advantageously consist of stationary curved units containing one or more openings for ejection of a gas under pressure, preferably at low temperature, creating under said band a gas cushion with Coanda effect, which maintains it at a fixed distance from said unit.

In one advantageous embodiment of the invention, the device will contain, "downstream" with respect to the direction of movement of the band of the zone of impact of the molten metal and face to face with the surface opposite the impact surface, a preferably concave unit with Coanda effect, so placed that the moving band follows, after impact of the molten metal, a path having a curvature corresponding to a concavity of the impact face of said band, and thus tending, by effect of inertia, to keep the strip in close contact with the band.

As indicated above, the rapid solidification device, according to the invention, lends itself particularly well to continuous rapid solidification under a controlled atmosphere and, in particular, under reduced pressure. In this connection, the rapid solidification device comprises a vessel in which is placed the opening for ejection under pressure of the molten metal or alloy, which continuously crosses said band. An inlet slit and an outlet gate are provided for passage of the band in said vessel, as well as at least one opening for control of the atmosphere which is capable of serving as a vacuum connection for work under reduced pressure.

It is, of course, not generally desirable for the gas ejection openings of the cushion with Coanda effect to feed into the vessel, and that possibility is even practically excluded, when the installation is used under reduced pressure. In that event, it is desirable for a cushion with Coanda effect to be placed under the band downstream of the vessel and as close as possible to the outlet gate, in order to avoid friction of the upper face of the band with the outlet gate, and it is advantageous for a second cushion to be placed upstream of the vessel and as close as possible to the inlet slit.

That inlet slit, which is intended only to permit free passage of the supporting band, of well-defined section and position, can be made in the form of various devices of the known art, such as intermediate joints, locks or chambers, which keep the intake of air inside the vessel at a low level.

The outlet gate is more difficult to make, for it must make possible, not only passage of the supporting band, but also that of the strip manufactured inside the vessel. In particular, when the vessel is placed under reduced pressure, due to the play to be expected necessarily above the band for outlet of the strip, a gas flow is produced, emanating from outside the vessel, which tends to separate the strip from the band and prevent its outlet and, therefore, its recovery. However, tests showed that this difficulty is overcome when the distance between the impact zone and the outlet is below a critical value. The latter is generally very low, in the order of a centimeter, and seems to correspond to the zone where the strip is still hot enough to adhere to the band.

To prevent the gas flow coming from outside the vessel through the outlet gate, from disturbing the jet of molten metal, the bulb formed on its impact on the band, and the spread and cooling of the strip, it is advisable for the vacuum connection or connections of the vessel to be placed in the immediate vicinity of the outlet gate. Those vacuum connections are preferably arranged, in identical pairs, symmetrically with respect to the supporting band and in proximity to its edges.

In practice, maintenance of the distance between the impact zone and outlet below a maximum critical value is rendered difficult by the size of certain members and, notably, of the crucible containing the molten metal and its means of heating, to be placed in that region of the vessel.

To remedy that difficulty, it is possible to use an outlet gate structure shifted toward the inside of the vessel and preferably removable and interchangeable, so as to enable the device to be easily adapted to the working conditions chosen, such as the dimensions and speed of the band, the nature of the alloy and the temperature of use and the width of the strip to be produced.

Tests further showed that there is one advantageous embodiment capable of accommodating the size of the different members, some of which are at high temperature, situated inside the vessel in the outlet zone. In fact, the strip is produced and its emergence from the vessel under reduced pressure effected quite well, even if the distance between the impact zone and the lower wall of the vessel is quite great, when one places, above and at a very short distance from the strip supported by the band, a hood-shaped piece having a surface roughly parallel to the latter and covering it to the outlet from a distance from the impact zone equal to not more than the critical distance previously defined.

The use of such hoods is particularly advantageous, for it makes it possible to place lateral vacuum connections, situated in the vicinity of the outlet and on both sides of the band, in very direct connection with the slit through which the strip comes out of the vessel.

The tests conducted under reduced pressure with such a device proved fully satisfactory, for one finds that the metal glass strip formed in contact with the band remains adhered to the latter over a distance sufficient to enable it to be extracted from the vacuum chamber, in order to be able to recover it then continuously, e.g., by centrifugal ejection.

BRIEF DESCRIPTION OF THE DRAWINGS

The attached drawings represent embodiments of the invention, which are now going to be described more in detail. In those drawings.

BEST MODE FOR CARRYING OUT THE INVENTION

Figure 1:
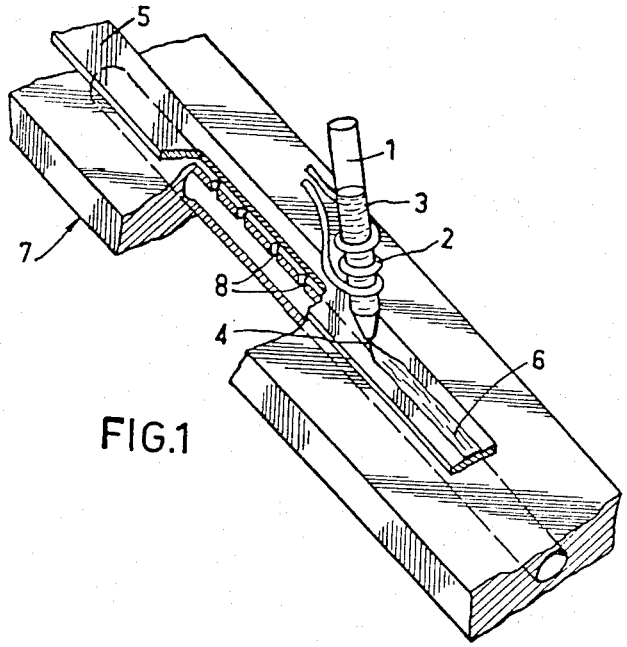
FIG. 1 is a schematic view illustrating a rapid solidification device according to the invention, equipped with a unit with Coanda effect, placed below the moving band.

First, FIG. 1 will be referred to, showing a crucible 1, surrounded outside by a solenoid 2, making it possible to heat to a temperature exceeding melting temperature the metal 3 contained in crucible 1. The molten metal can be ejected under pressure through a nozzle 4 in the direction of a metal band 5, driven at great speed by means not represented under nozzle 4. In contact with band 5, the molten metal undergoes a rapid solidification and is solidified to form a metal strip 6 in the vitreous state, which adheres to band 5 and is driven by the latter.

Figure 2:
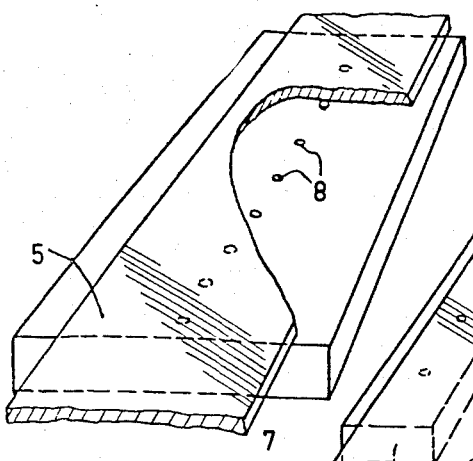
FIGS. 2 to 5 represent different variants of such a unit.

According to the invention, a unit 7, drilled with holes 8 along the middle line of band 5 (FIG. 2), is placed below the latter, and a gas under pressure (air, helium, nitrogen or other gas), preferably at low temperature, is projected through holes 8 in the direction of band 5, so as to form under that band a gas cushion, which applies it against unit 7 by Coanda effect. The gas cushion guides that band in its high-speed movement under nozzle 4 and thus eliminates its vibrations, notably, those originating from the drive device. It also contributes to the cooling of band 5, in order to remove the calories introduced by the molten metal.

Figure 3:
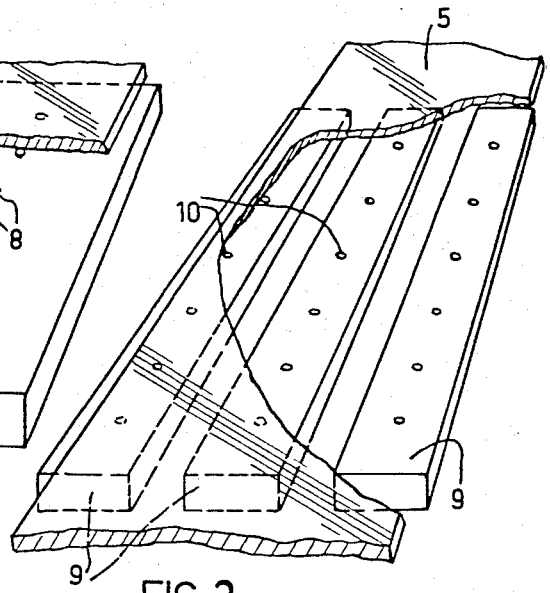
Figure 4:
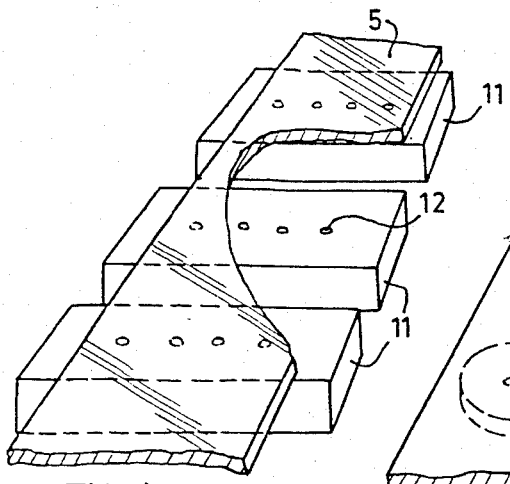

It is, of course, possible to use a multiple number of units 9 drilled with holes 10 aligned parallel to the direction of feed of band 5 (FIG. 3) or units 11, provided with openings 12, placed perpendicular to band 5 (FIG. 4).

Figure 5:
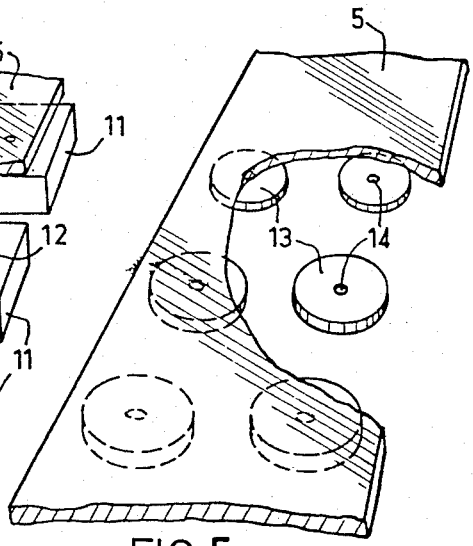

Studs 13 can also be used, provided with openings 14 (FIG. 5), possibly in staggered arrangement. The openings may also be in the form of slits.

As indicated above, the device according to the invention, is particularly suitable for rapid solidification under reduced pressure or under any controlled atmosphere.

Figure 6:
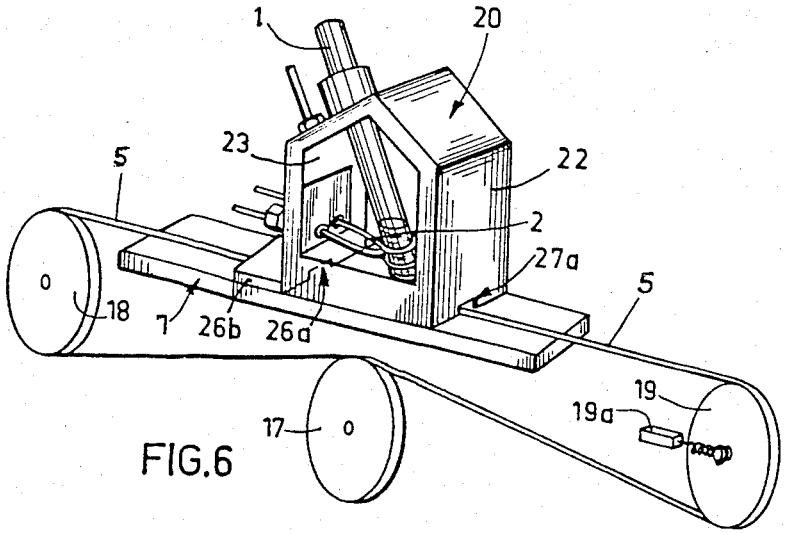
FIG. 6 is a schematic view of a device according to the invention for rapid solidification of a metal or alloy under controlled atmosphere.

FIG. 6 illustrates such an application. Moving band 5, pulled by a drive pulley 17, passes over two return pulleys, one stationary 18 and the other 19 mounted on a tension block 19*a*. It crosses a vessel 20, the lower part of which consists of the plate of a cooled unit 7, containing openings, fed with fluid under pressure, forming the gas cushion by means of the Coanda effect. Those openings, placed under band 5 solely upstream and downstream of the site of vessel 20, are not visible in the figure.

In the case of the drawing, vessel 20 contains a frame 22, laterally equipped with transparent walls 23, making it possible to observe the operations. In vessel 20, as previously, a crucible 1 is provided, equipped with a solenoid 2, which makes it possible to melt the metal or alloy contained in the crucible.

Vessel 20 contains, for the passage of band 5, an inlet opening 26*a* (FIG. 6), blocked by a removable piece 26*b* (FIG. 10), whose lower face, which contains a groove of width and depth suited, with a slight play, to the dimensions of band 5, is applied to supporting unit 7, and an outlet opening 27*a* (FIG. 6), blocked by a gate 27*b* (FIG. 10), also mounted on the unit so as to allow passage of the band and vitreous metal strip.

Improved variants of the outlet gate are described below.

Figure 7:
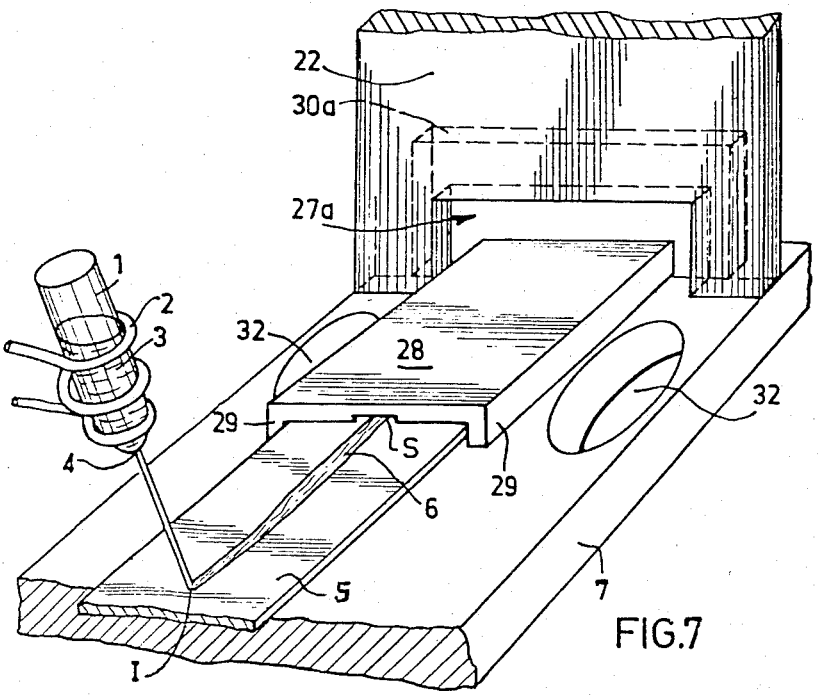
FIG. 7 is a partial schematic view, from inside the vessel, showing a shifted outlet gate, for work under reduced pressure, and the vacuum connections provided nearby.

FIG. 7 shows one embodiment of an outlet gate according to the invention, presenting a tunnel with opening shifted toward the inside of the vessel. That tunnel is part of a corner-shaped removable piece possessing, on one side, a wing 28, roughly parallel to supporting unit 7 and resting on it by its two edges 29, and the lower face of the wing 28 presenting a recess of profile adapted to the section of band 5 and to that of strip 6; and, on the other side, a wing 30*a*, arranged in the same way as gate 27*b* of FIG. 10, whose face turned toward the inside of the corner is trued in order to be applied tightly under the effect of the vacuum prevailing in the vessel against the outside wall 22 of the vessel, which is in turn trued on its surface in contact with wing 30*a*. Owing to its removable character, that outlet gate has the advantage of being easily adapted to changes in working conditions, without requiring any other modification of the essential feature of the device, and of preventing blocking of the band thanks to its free play, in case of malfunction.

Figure 8:
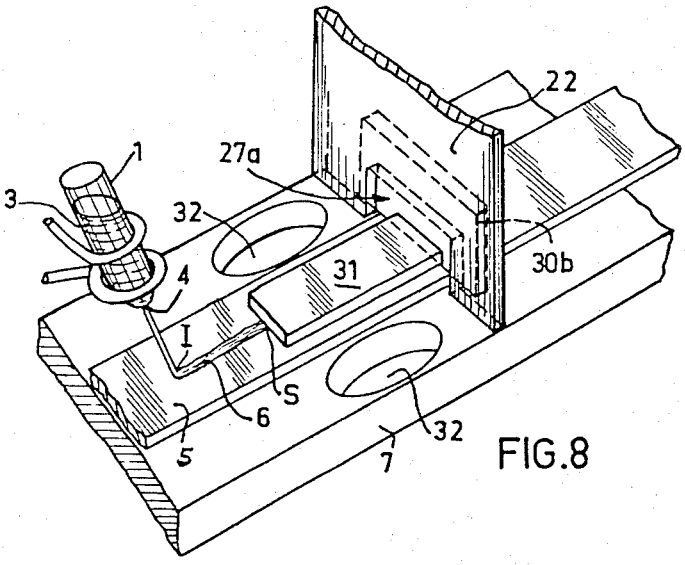
FIG. 8 is a similar view showing a hooded outlet structure.

In the variant containing a hood, represented by FIG. 8, the general shape of the removable piece resembles that of FIG. 7, with a wing 30*b* applied on wall 22. Its wing 31 does not, however, contain edges in contact with unit 7, but takes the form of a plate, the lower face of which is flat, roughly parallel to the strip and situated a short distance from same. The corner angle can advantageously be slightly less than 90°, e.g., of the order of 85° to 88°.

In FIGS. 7 and 8, the zones of impact of the molten alloy on band 5 have been marked by letter I, and the points where strip 6 is engaged under wings 28 and 31 of the outlet gates, i.e., in fact, the inside thresholds of said gates, by letter S. According to the invention, distances IS must be less than a critical distance depending on working conditions.

Figure 10:
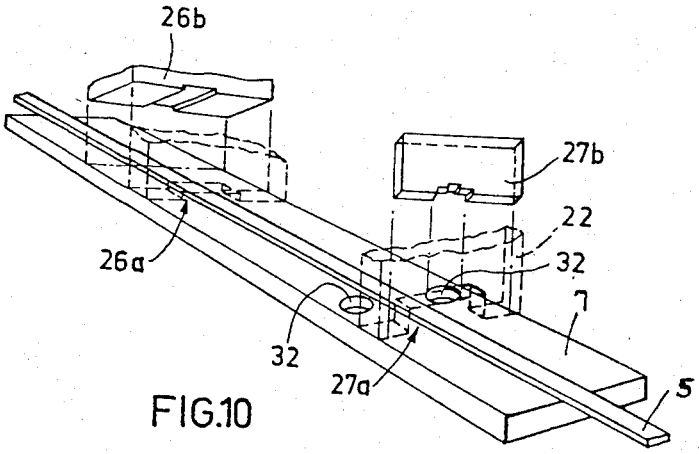
FIG. 10 is an exploded detailed view showing simple forms of inlet and outlet pieces of the vessel.

Vessel 20 is, of course, equipped with vacuum connections 32, numbering two, placed beside band 5, in the case of FIGS. 7, 8 and 10. As indicated above, openings 32 must be placed as close as possible to the gate of the vessel.

It has also been found that the best results are obtained when the jet of molten metal is inclined in relation to band 5, by an angle of 60°, for example. Under these conditions, the metal strip is formed on band 5 with fewest risks of projecting drops of molten metal on the sides and toward the back.

Figure 9:
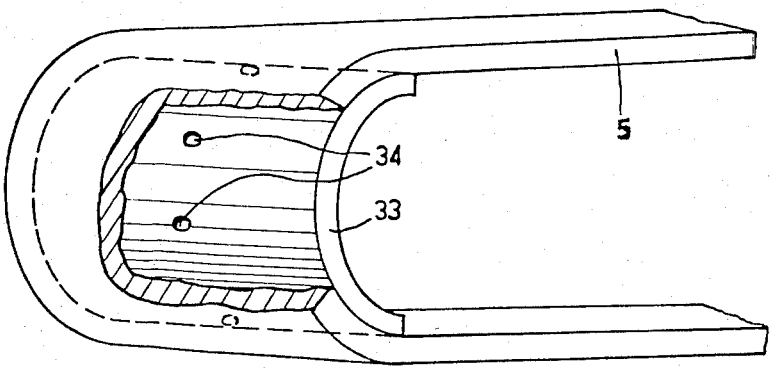
FIG. 9 is a broken-away schematic view showing a stationary curved return member with Coanda effect for the moving band.

As already indicated, one can advantageously substitute for return pulleys 18 and 19 fixed curved return members 33, whether convex (FIG. 9) or concave, bored with openings 34 for ejection of a gas under pressure, preferably at low temperature, which apply, by Coanda effect, band 5 against member 33. Friction of the band with the return members is thus avoided, which contributes to limiting the vibrations and to cooling band 5.

One working example will now be described. It uses a device containing an endless steel band, approximately 4 meters long and 16 mm×1 mm in section, capable of being driven at a speed ranging between 0 and 3,000 m/minute, sliding on a flat supporting unit 10 cm wide and 50 cm long, which includes openings for ejection of gas under pressure, 1.5 mm in diameter and 2 cm apart. Those openings are arranged along the axis of the band, over the whole length of the unit, except opposite the vessel and inlet and outlet pieces, i.e., over approximately 15 cm. Crucibles 1 are used, drilled with an opening varying between 0.3 and 0.8 mm in diameter, approximately 5 mm away from the band and arranged so that the jet of molten metal forms an angle of 60° with the latter. A 1.5-KW vacuum pump makes it possible to obtain easily an absolute pressure in the vessel of 0.05 bar. The excess pressure of ejection of a molten metal through the opening makes it possible to regulate the flow and was chosen for these tests of the order of 0.5 to 1 bar.

These devices according to the invention make it possible to obtain metal glasses, particularly alloys of type $A_x$-$B_{1-x}$, where A consists of one or more transition metals (Fe, Cr, Ni, Mn, Co, etc.) and B of one or more metalloids (P, C, Si, B, etc.), and where x, which is the atomic fraction of A, is of the order of 0.8. Those alloys are known to yield, by sudden solidification, products in the vitreous state.

The best results were obtained under reduced pressure, e.g., of the order of 0.05 bar, by means of the devices illustrated by FIGS. 7 and 8.

For band speeds of 1,000 to 3,000 m/minute, and with a distance IS less than a critical value ranging between 10 and 20 mm and a tunnel or hood length of the order of 5 cm, it was possible to obtain with those alloys strips 1 to 7 mm wide and 30 to 100 μm thick; those strips presented regular edges and flat faces, qualities that can be attributed to work under vacuum. Furthermore, the products obtained exhibited a ductility greater than that of strips of the same kind, which are manufactured under vacuum in totally closed vessels. That advantage seems attributable to the very rapid outlet of the strip from the vessel under reduced pressure, which makes possible a more effective solidification, close to that obtained by solidification in a nonrarefied atmosphere, due to an increase in the rate of cooling of the metal alloy in the temperature zone situated above the so-called vitrification temperature.

This invention thus also concerns a process of manufacture of thin metal strips by projection of a jet of molten metal or alloy on a cold substrate moving at great speed, in which the impact of the jet and forming of the strip, in contact with the substrate, takes place in an atmosphere under reduced pressure, and in which, before its temperature reaches the temperature of vitrification of said metal alloy, the strip is brought into an atmosphere of higher pressure.

We claim:

1. An apparatus for rapidly solidifying a metal or alloy on its formation into a thin strip comprising a band moving at high speed, a means for ejection under pressure of a metal or alloy in molten state, situated above the high speed band, said band having a zone of impact in which said molten metal or alloy impacts on said band after said ejection, at least one perforated unit containing at least one opening for the ejection of a pressurized gaseous fluid at low temperature opposite at least one of the faces of said band and in proximity to said zone of impact of the molten metal or alloy on said band, said ejected gaseous fluid creating between said unit and said band a fluid cushion which maintains said band in position without friction against said unit and substantially without other means of support in proximity to said zone of impact.

2. An apparatus according to claim 1, in which the perforated unit for the ejection of gaseous fluid under pressure is placed upstream of the impact zone of the molten metal on said band and opposite the impact face.

3. An apparatus according to claim 1, in which the perforated unit contains a multiple number of openings for ejection of a gaseous fluid under pressure.

4. An apparatus according to claim 1, in which the moving band consists of a continuous metal belt pulled by a drive member and passing over return members, characterized in that at least one of said return members consists of a fixed curved unit containing at least one opening for ejection of a gaseous fluid under pressure, at low temperature, with a view to creating between said fixed curved unit and said band a fluid cushion which maintains said band in position without friction against said fixed curved unit.

5. An apparatus according to claim 1, in which the means for ejecting molten metal or alloy comprises a crucible having an opening for ejection under pressure of the molten metal or alloy housed in a vessel which continuously bridges the moving band in proximity to said zone of impact, the vessel having an inlet slit and an outlet gate having an inside threshold, and having at least one vacuum connection means for the control of the vessel's atmosphere.

6. An apparatus according to claim 1, in which the axis of ejection of the molten metal or alloy is inclined in relation to said band, forming an acute angle, opened upstream, with the band.

7. An apparatus according to claim 1, in which the perforated unit contains at least one opening in the form of a straight slit, placed under the middle line of said band.

8. An apparatus according to claim 3, in which said openings are aligned along at least one straight line parallel to the direction of feed of the moving band.

9. An apparatus according to claim 3, in which said openings are aligned along at least one straight line perpendicular to the direction of feed of the moving band.

10. An apparatus according to claim 4, in which the fixed curved unit comprises a concave unit which contains said at least one opening for ejection of a gaseous fluid under pressure, said opening being oriented to direct said gaseous fluid so that said gaseous fluid adheres to a surface of at least one of said concave unit and said band by the Coanda effect, situated downstream of the zone of impact of the molten metal and face to face with the surface of the band opposite the impact surface, so that the moving band follows, after impact of the molten metal, a path having a curvature corresponding to the concavity of the impact face of said band.

11. An apparatus according to claim 4, in which the fixed curved unit comprises a convex unit which contains said at least one opening for ejection of a gaseous fluid under pressure, said opening being oriented to direct said gaseous fluid so that said gaseous fluid adheres to a surface of at least one of said convex unit and said band by the Coanda effect, situated downstream of the zone of impact of the molten metal and face-to-face with the surface of the band opposite the impact surface, so that the moving band follows, after impact of the molten metal, a path having a curvature corresponding to the convexity of the impact face of said band.

12. An apparatus according to claim 5, in which the vacuum connection means comprises at least one opening in the vessel which is placed in the immediate vicinity of the outlet gate of the vessel.

13. An apparatus according to claim 12 in which two vacuum connection means are placed beside the moving band along each edge of the band and approximately in its plane.

14. An apparatus according to claim 5, having at least two of said perforated units containing at least one opening for the ejection of a pressurized gaseous fluid, said opening being oriented to direct said gaseous fluid so that said gaseous fluid adheres to a surface of a least one of said perforated unit and said band by the Coanda effect, one of which units is situated upstream of and the other downstream of the vessel.

15. An apparatus according to claim 5, in which the lower wall of the molten metal dispensing vessel comprises the plate of a cooled support whose ends outside the vessel constitute units having at least one opening for ejection of a gaseous fluid under pressure, said opening being oriented to direct said gaseous fluid so that said gaseous fluid adheres to a surface of at least one of said plate and said band by the Coanda effect in the vicinity of the impact zone.

16. An apparatus according to claim 5 in which the distance from the impact zone to the inside threshold of the outlet gate is less than a critical distance, so that the temperature of the strip on crossing of said threshold is still high enough to guarantee the adhesion of said strip to the band.

17. An apparatus according to claim 5 in which the vessel contains above and at a very short distance from the strip supported by the band, a piece having a surface approximately parallel to the band and covering it to the outlet, from such distance from the impact zone that the temperature of the strip on crossing of the threshold of said piece is still high enough to guarantee the adhesion of the strip to the band.

18. An apparatus according to claim 17 in which the lower surface of the piece covering the strip to the outlet forms an angle of between 0° to 5° with the strip, the opening of which angle is directed toward the metal jet.

19. An apparatus according to claim 5, in which said vacuum connection means for the control of said vessel's atmosphere is operated so that an atmosphere having reduced pressure exists in proximity to said zone of impact of said molten metal or alloy on said band; and in which said speed of said moving band, and the distance from said zone of impact to said inside threshold of said outlet gate, are such that said strip is formed in contact with said band in said atmosphere under reduced pressure, and said strip is brought into an atmosphere of higher pressure before its temperature reaches the temperature of vitrification of said metal or alloy.

* * * * *